US005944481A

United States Patent [19]

Stone et al.

[11] Patent Number: 5,944,481

[45] Date of Patent: Aug. 31, 1999

[54] TRANSVERSE FAN WITH FLOW STABILIZER

[75] Inventors: Scott D. Stone, Cicero; John F. Salvaterra, Camillus, both of N.Y.

[73] Assignee: Carrier Corporation, Syracuse, N.Y.

[21] Appl. No.: 08/967,637

[22] Filed: Nov. 10, 1997

[51] Int. Cl.[6] ..... F04D 5/00; F04D 23/00; F01D 9/00

[52] U.S. Cl. ..... 415/53.1; 415/53.1; 415/53.2; 415/53.3; 415/119; 415/211.1; 415/211.2

[58] Field of Search ..... 415/53.1, 53.2, 415/53.3, 119, 211.1, 211.2

[56] References Cited

U.S. PATENT DOCUMENTS

| | | | |
|---|---|---|---|
| 4,014,625 | 3/1977 | Yamamoto . | |
| 5,094,586 | 3/1992 | Takada et al. . | |
| 5,127,238 | 7/1992 | Ichikawa | 62/244 |
| 5,669,229 | 9/1997 | Ohbayashi | 62/259.1 |

FOREIGN PATENT DOCUMENTS

| | | | |
|---|---|---|---|
| 0 132 780 | 2/1985 | European Pat. Off. . | |
| 2 266 016 | 10/1975 | France . | |
| 34 06 368 | 8/1985 | Germany . | |
| 34 18 160 | 11/1985 | Germany . | |
| 5-87087 | 4/1993 | Japan | 415/53.3 |
| 5-87087 | 4/1994 | Japan | 415/53.3 |

*Primary Examiner*—Edward K. Look
*Assistant Examiner*—Rhonda Barton

[57] ABSTRACT

The discharge flow path of a transverse fan is modified by placing ramps on the rear/bottom wall to provide localized acceleration of the flow while preventing the establishment of flow instability. The ramps reduce the noise generated without deteriorating the performance of the unit.

10 Claims, 5 Drawing Sheets

TRANSVERSE FAN WITH FLOW STABILIZER

BACKGROUND OF THE INVENTION

Transverse fans are also known as cross-flow and tangential fans. They are used in air conditioning applications because of their in-line flow capabilities and their suitable relationship with plate-fin heat exchangers since they can extend the entire length of a heat exchanger. To achieve the desired length, the impeller can be made up of a plurality of segments or modules with one or more segments being shorter than the others in order to achieve the total desired length. In a transverse fan, the inlet and outlet are, generally, nominally, at right angles but angles from 0 to 180° are possible. The impeller is similar to a forward curved centrifugal fan wheel except that it is closed at both ends. The flow is perpendicular to the impeller axis throughout the fan, and enters the blade row in the radially inward direction on the upstream side, passing through the interior of the impeller, and then flowing radially outward through the blading a second time. The flow is characterized by the formation of an eccentric vortex that runs parallel to the rotor axis and which rotates in the same direction as the rotor.

A two stage action occurs as the flow passes first through the suction (upstream) blading and then through the discharge blades. The flow contracts as it moves across the impeller producing high velocities at the discharge blades (second stage). The flow leaves the impeller and contracts again as it turns and squeezes around the vortex. The combination of these effects results in the high pressure coefficients attained by transverse fans. A vortex wall separates the inlet from the outlet and acts to stabilize the vortex. Since there is only re-circulating flow in the region of the vortex, no useful work is done there. The main effect in the vortex is energy dissipation. Fan stability is, however, highly sensitive to vortex wall clearance. This parameter must be controlled very carefully since a trade-off is made between stable, high performance and tone noise generated by interaction of the impeller with the vortex wall. The vortex wall coacts with the blades of the impeller as they move from the discharge side to the suction side. In a high wall indoor fan coil unit of a duct-free split system a noise problem existed caused by unstable flow due to flow separation from the rear/bottom wall, particularly near the two end walls. It is speculated that a vortex, or flow separation, was being established on the rear/bottom wall.

SUMMARY OF THE INVENTION

The present invention is directed to providing flow stabilization for a transverse fan. Flow stabilization is achieved by causing flow acceleration in the vicinity of the walls where a vortex, or flow separation, was believed to be established. The flow stabilization was achieved by locating flow stabilizers in the nature of ramps on the rear/bottom wall near the ends of the impeller. In section, in the direction of flow, suitable ramps approximated one quarter of an ellipse and a bell curve, respectively. The ramps have a maximum cross sectional area transverse to the flow in the range of 0.2 to 1.5 square inches. The presence of the ramps reduces the noise by about 5 dB with specific ramp dimensions and placement generally having an influence on the noise level of less than 1 dB. The ramps may be upstream of the discharge by as little as 0.25 inches or to a point where clearance with the impeller becomes a factor, e.g., 5 inches upstream of the discharge. The position upstream of the discharge influences the percentage of the discharge path taken up by the ramps with the percentage increasing as the location moves upsteam. Generally, the maximum percentage of the discharge path taken up by the ramps is less than 1%, but a range of 0.5 to 20% is possible.

It is an object of this invention to provide flow stabilization.

It is another object of this invention to decrease noise generation. These objects, and others as will become apparent hereinafter, are accomplished by the present invention.

Basically, the discharge flow path of a transverse fan is modified by locating ramps on the rear/bottom wall to provide localized acceleration of the flow while preventing the establishment of flow instability. The ramps reduce the noise generated without deteriorating the performance of the unit.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
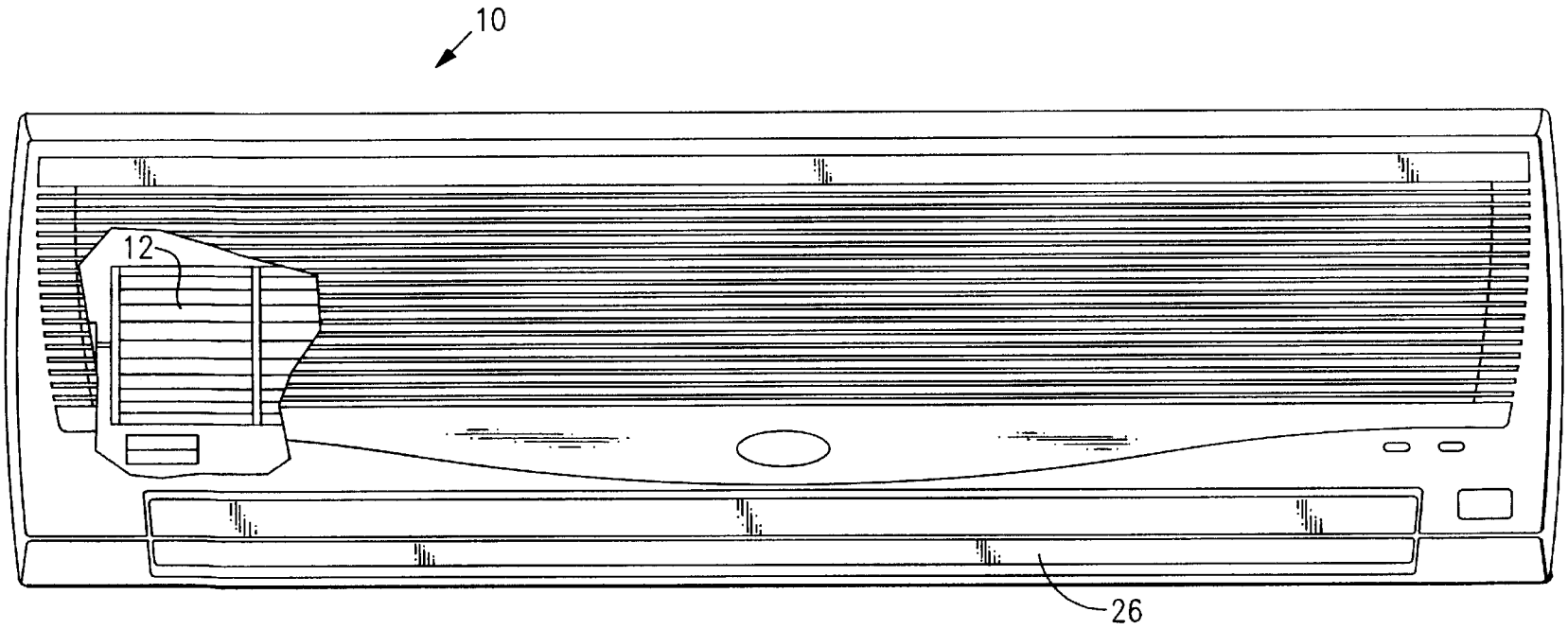
FIG. 1 is a partially cutaway view of a fan coil unit.
Figure 2:
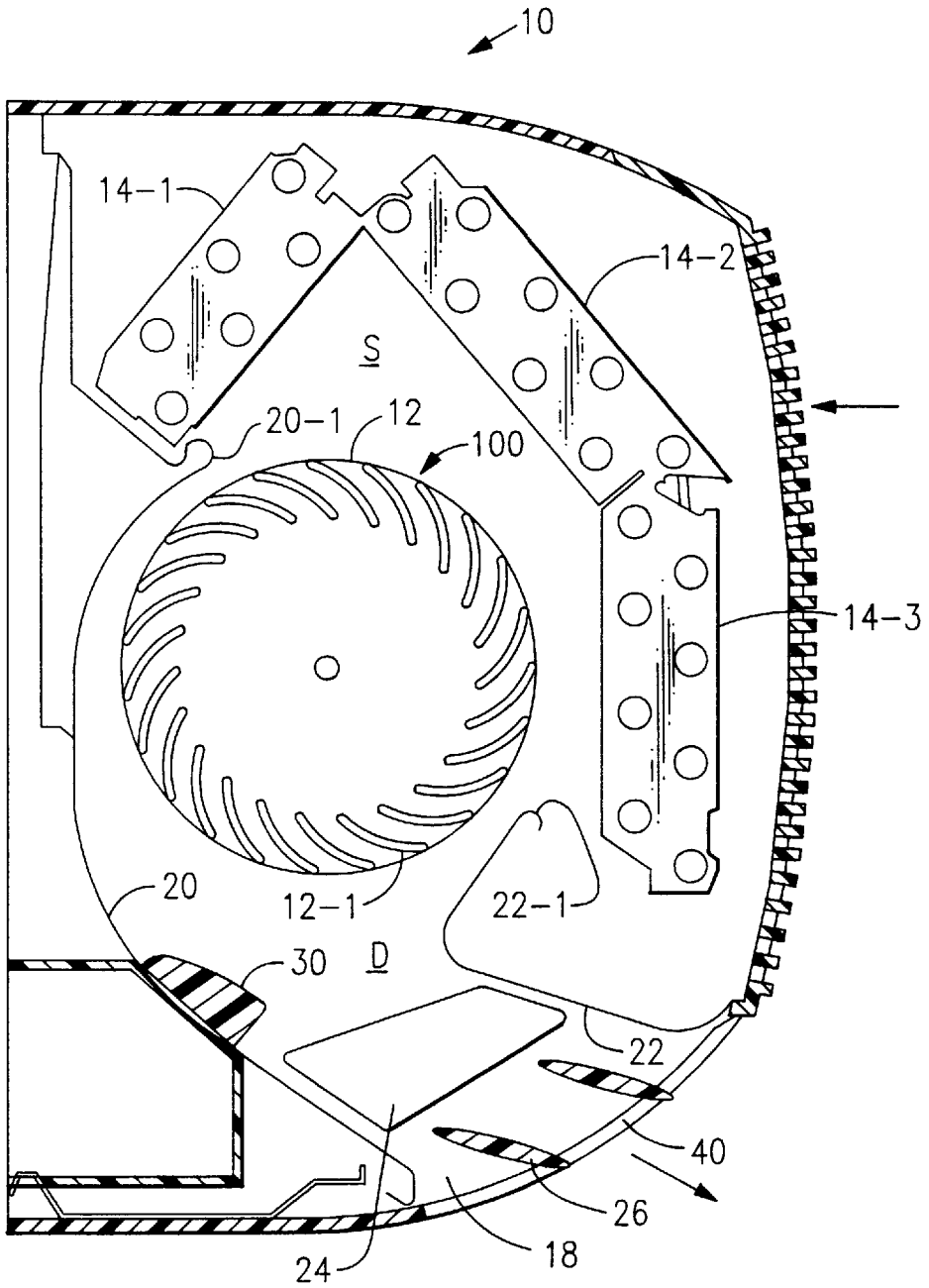
FIG. 2 is a vertical sectional view of a fan coil unit employing the present invention.

In FIGS. 1 and 2, the numeral 10 generally designates the indoor fan coil unit of a split system. As is conventional, rotation of impeller or rotor 12 draws air through heat exchanger portions 14-1, 14-2 and 14-3 which collectively make up the evaporator of a split air conditioning system in the cooling mode and the condenser in the heating mode. After passing through the heat exchanger portions 14-1 through 14-3, the heated/cooled air passes through impeller 12 into the discharge defined by end walls 18, rear/bottom wall 20 and vortex wall 22. Curved inlet portion 20-1 of rear wall 20 and tip 22-1 of vortex wall 22 coact with impeller 12 to define and separate the suction side, S, from the discharge side, D, of fan 100. The heated/cooled air passes from the discharge serially via louvers 24 and 26 into the room. Louvers 24 and 26 are, typically, rotatable and at 90° with each other so as to permit the directing of air flow into the room.

Figure 3:
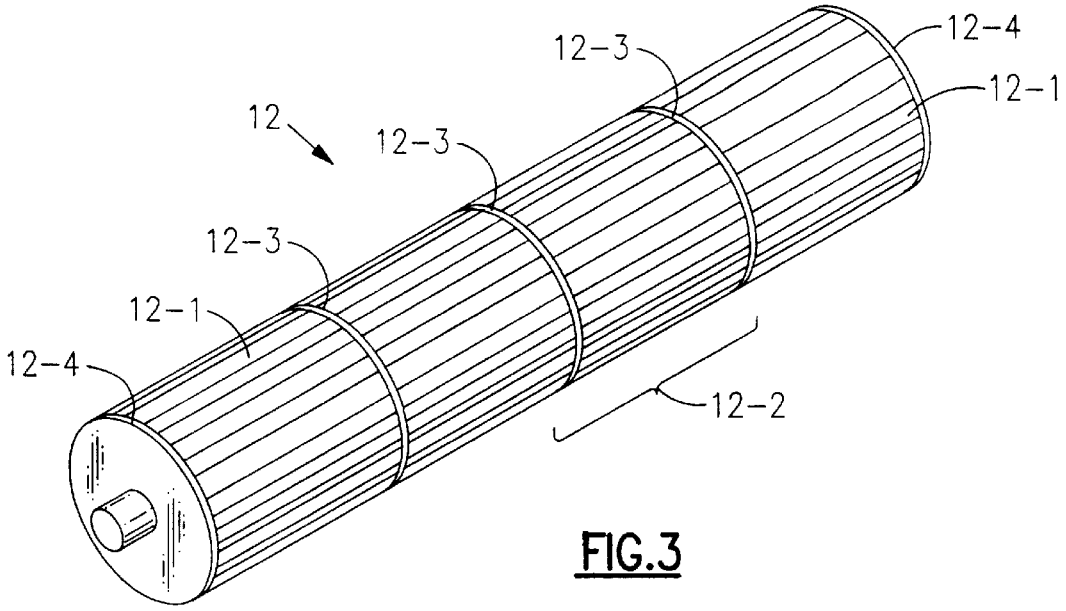
FIG. 3 is a pictorial view of the fan impeller of FIG. 1.

Referring specifically to FIG. 3, impeller or rotor 12 is generally cylindrical and has a plurality of blades 12-1 disposed axially along its outer surface. Impeller 12 is made up of several modules 12-2 each defined by an adjacent pair of partition disks 12-3 or by one end disk 12-4 and one partition disk 12-3. A plurality of blades 12-1 extend longitudinally between each adjacent pair of disks. Each blade 12-1 is attached at one of its longitudinal ends to one disk and at the other end to the other disk of the pair. A given impeller 12 may comprise multiple modules, as depicted in FIG. 3, or a single module, where the blades attach at either end to an end disk. Where multiple modules are used in order to achieve a desired length, the module lengths may be different with the end modules usually being of modified length.

Figure 4:
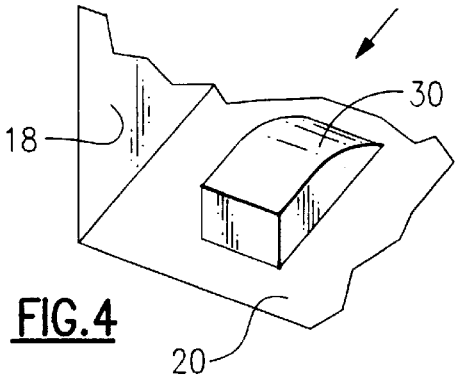
FIG. 4 is a pictorial view of the ramp of FIG. 1.
Figure 7:
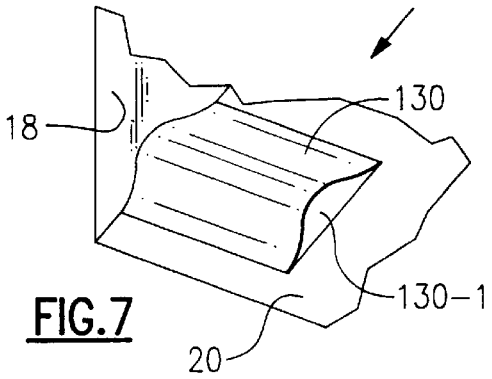
FIG. 7 is a pictorial view of a first modified ramp.
Figure 8:
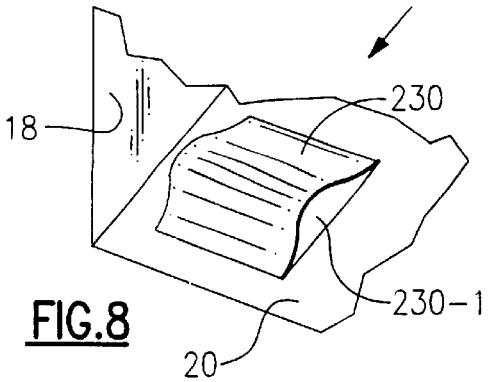
FIG. 8 is a pictorial view of a second modified ramp.
Figure 5:
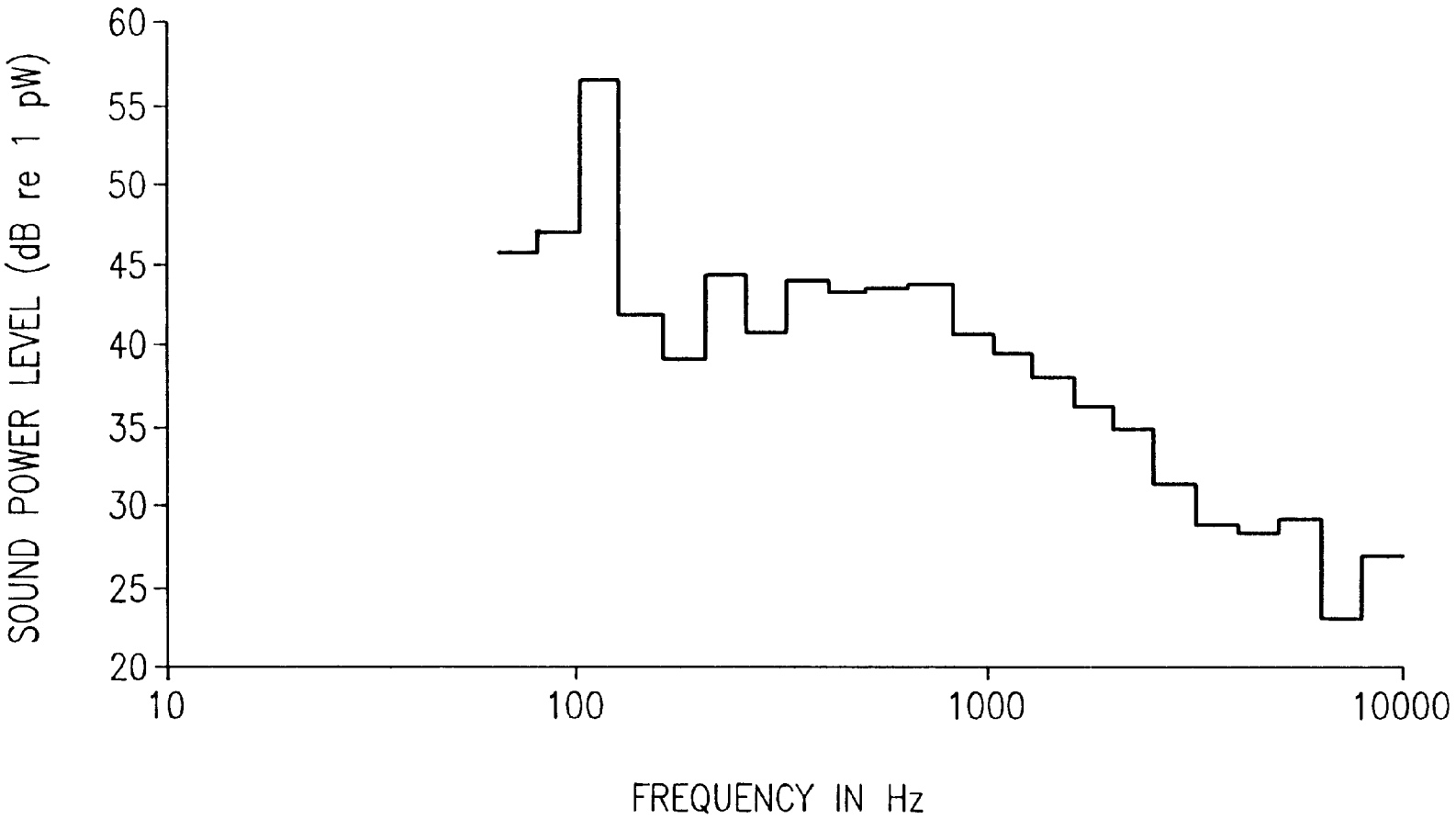
FIG. 5 is a plot of sound power level in decibels referenced to picowatts (dB re $1\times10^{-12}$W) vs. frequency in Hz for a unit without the ramp.

The unit described so far is generally conventional. A unit having an impeller 21.89 inches long, 3.5 inches in diameter with thirty five blades and discharge area of 61.29 square inches operating at 1050 rpm was tested and produced the graph of FIG. 5. Additionally, the discharge was measured as 234.9 cfm and the ⅓ octave sound power (Lw) was 50.3 dB. The unit 10 was then modified by placing ramps 30 on wall 20. As best shown in FIG. 1, a ramp 30 is preferably located at or near each end of the rotor 12. Suitable ramps 30, 130 and 230, as illustrated in FIGS. 4, 7 and 8, respectively, are in the shape of one quarter of an ellipse or of a bell curve in the direction of flow, which is indicated by an arrow, so as to provide an air guiding surface for directing and accelerating flow. The ramps 30 can be from 0.20 to 0.75 inches high, 0.5 to 1.5 inches long and 0.4 to 1.5 inches wide. Ramps 30 can be located within three inches of one of the end walls and discharge but placement of the ramps 30 generally should be at or between 0.75 and 1.75 inches from the end walls 18 and 0.25 to 5 inches upstream of the louvers 24 and 26 in discharge 40 when two ramps are used in the described device.

Figure 6:
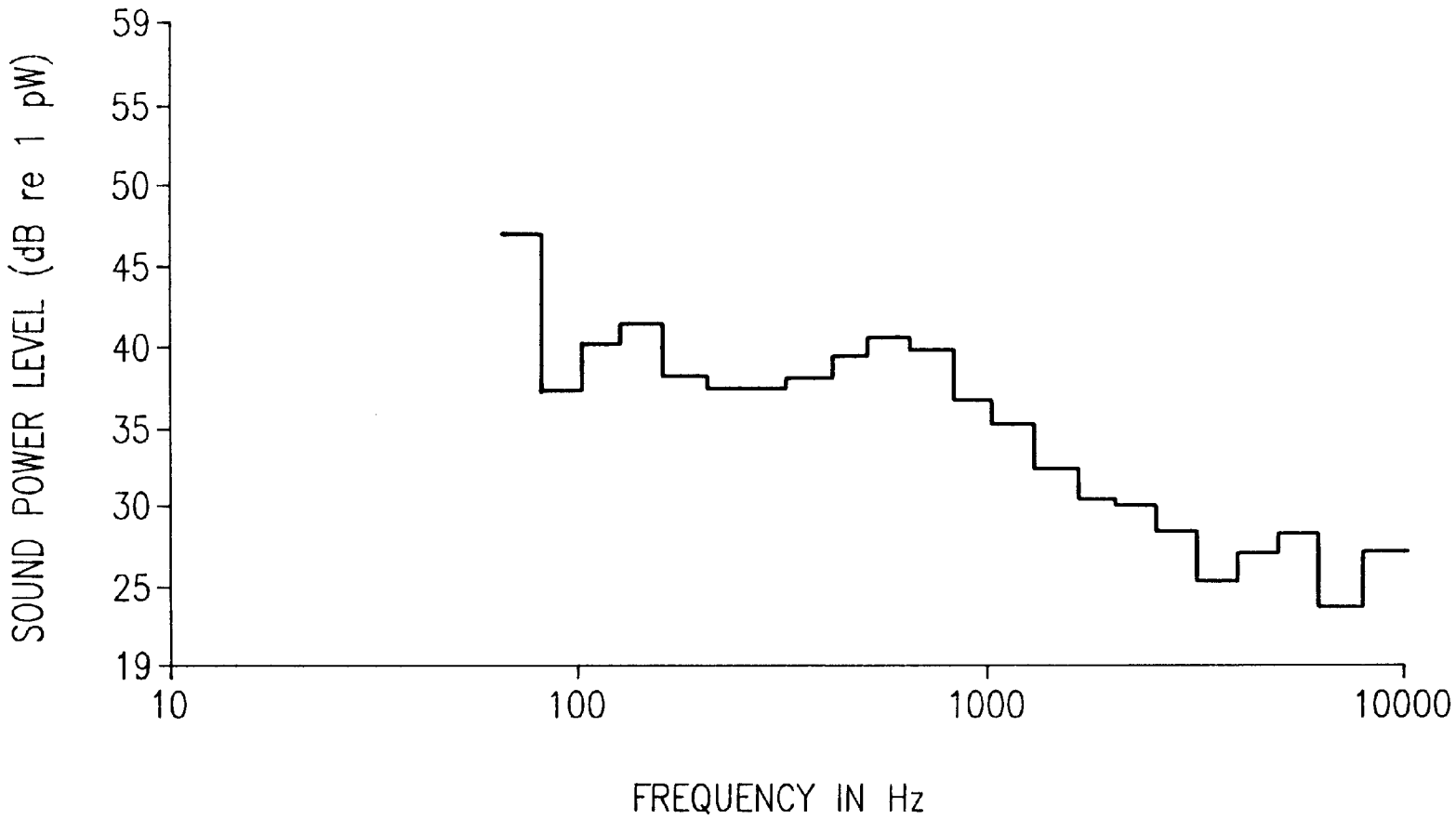
FIG. 6 is a plot of sound power level in decibels referenced to picowatts (dB re $1\times10^{-12}$W) vs. frequency in Hz for a unit having two ramps in place according to the teachings of the present invention.

With a pair of ramps 30 in place each having a height of 0.31 inches, a length of 0.75 inches, a width of 0.88 inches, located 0.3 inches upstream from louvers 24 and 1.2 inches from respective end walls 18, the unit 10 was run under the same conditions as described above. FIG. 6 illustrates the test results. Additionally, the discharge was measured as 241.6 cfm and the ⅓ octave sound power (Lw) was 45.2 dB. Thus, the present invention provided a nominal flow increase together with a 5.1 dB reduction in noise.

Referring now to FIG. 7, a modified ramp 130 is illustrated. Ramp 130 differs from ramp 30 in that it is symmetrical in the direction of flow, specifically side 130-1 of ramp 130 defines a bell shaped curve. As in the case of ramp 30, a wide range of dimensions are suitable. With ramps 130 engaging walls 18, a suitable width is 1.25 inches, a suitable length is 1.0 inches and the height may be from 0.38 to 0.5 inches with the top portion being a portion of a circle of a diameter corresponding to the height. Referring now to FIG. 8, modified ramp 230 differs from ramp 130 in that it is spaced from wall 18. Side 230-1, like side 130-1, define a bell shaped curve in the direction of flow. Where the ramps engage walls 18, they tend to be wider than in the case where they are spaced from walls 18.

Although preferred embodiments of the present invention have been illustrated and described, other modifications will occur to those skilled in the art. For example, other shapes may be provided for the ramps where they act as air guides. Also, in some cases due to the dimensions of the unit it may be desirable to use more than two ramps and the ramp size and spacing may be changed as by spacing the ramps three inches, or more from the side wall. However, the basic requirement for the ramps are that they provide a local acceleration of the flow while avoiding flow instability. It is therefore intended that the present invention is to be limited only by the scope of the appended claims.

What is claimed is:

1. A transverse fan device comprising:

an impeller;

a discharge flow path extending between said impeller and a discharge and defined by a rear wall, a vortex wall and a pair of end walls;

means for stabilizing flow in said discharge flow path;

said means for stabilizing flow including at least one member located on said rear wall at a location spaced from said end walls and said discharge but being within three inches of one of said end walls and said discharge.

2. The device of claim 1 wherein said means for stabilizing flow has an air guiding shape.

3. The device of claim 1 wherein said means for stabilizing flow includes a pair of members located in proximity with respective ones of said pair of end walls.

4. The device of claim 3 wherein said pair of members each have a curved surface which acts as an air guide.

5. A transverse fan device comprising:

an impeller;

a discharge flow path extending between said impeller and a discharge and defined by a rear wall, a vortex wall and a pair of end walls;

means for stabilizing flow in said discharge flow path;

said means for stabilizing flow includes a pair of members located in proximity with respective ones of said pair of end walls;

said pair of members each have a curved surface which acts as an air guide;

said curved surface is a portion of an ellipse;

said means for stabilizing flow being located intermediate said impeller and said discharge and providing a localized reduction in the cross sectional area of said discharge flow path.

6. The device of claim 5 wherein said localized reduction in the cross sectional area of said discharge is less than 20%.

7. A transverse fan device comprising:

an impeller;

a discharge flow path extending between said impeller and a discharge and defined by a rear wall, a vortex wall and a pair of end walls;

means for stabilizing flow in said discharge flow path;

said means for stabilizing flow includes a pair of members located in proximity with respective ones of said pair of end walls;

said pair of members each have a curved surface which acts as an air guide;

said curved surface is a portion of an ellipse;

said means for stabilizing flow being located on said rear wall at a location spaced from said end walls and said discharge but being within three inches of one of said end walls and said discharge.

8. A transverse fan device comprising:

an impeller;

a discharge flow path extending between said impeller and a discharge and defined by a rear wall, a vortex wall and a pair of end walls;

means for stabilizing flow in said discharge flow path;

said means for stabilizing flow includes a pair of members located in proximity with respective ones of said pair of end walls;

said pair of members each have a curved surface which acts as an air guide;

said curved surface is a portion of a bell shaped curve;

said means for stabilizing flow being located on said rear wall at a location spaced from said end walls and said discharge but being within three inches of one of said end walls and said discharge.

9. A transverse fan device comprising:

an impeller;

a discharge flow path extending between said impeller and a discharge and defined by a rear wall, a vortex wall and a pair of end walls;

means for stabilizing flow in said discharge flow path;

said means for stabilizing flow includes a pair of members located in proximity with respective ones of said pair of end walls;

said pair of members each have a curved surface which acts as an air guide;

said curved surface is a portion of a bell shaped curve;

said means for stabilizing flow being located intermediate said impeller and said discharge and providing a localized reduction in the cross sectional area of said discharge flow path.

10. The device of claim 9 wherein said localized reduction in the cross sectional area of said discharge is less than 20%.

* * * * *